US005403544A

United States Patent [19]

Adrian et al.

[11] Patent Number: 5,403,544

[45] Date of Patent: Apr. 4, 1995

[54] METHOD FOR FORMING HARD PARTICLE WEAR SURFACES

[75] Inventors: Richard L. Adrian, Dunlap; James C. Henehan, Wyoming; Phillip J. Shankwitz, Peoria, all of Ill.

[73] Assignee: Caterpillar Inc., Peoria, Ill.

[21] Appl. No.: 170,618

[22] Filed: Dec. 20, 1993

[51] Int. Cl.[6] ..... B22F 3/00

[52] U.S. Cl. ..... 419/36; 419/5; 419/9; 419/18; 419/23; 419/28; 419/40

[58] Field of Search ..... 419/5, 9, 28, 40, 23, 419/18, 36; 428/546, 553, 552; 427/367

[56] References Cited

U.S. PATENT DOCUMENTS

| | | | |
|---|---|---|---|
| 3,165,822 | 1/1965 | Beeghly | 29/182.7 |
| 3,490,901 | 1/1970 | Hachisuka et al. | 75/203 |
| 3,805,423 | 4/1974 | Engel et al. | 37/142 R |
| 3,989,863 | 11/1976 | Jackson et al. | 427/367 |
| 4,052,802 | 10/1977 | Moen et al. | 37/141 R |
| 4,086,966 | 5/1978 | Lanz et al. | 172/767 |
| 4,101,318 | 7/1978 | Rudy | 75/240 |
| 4,300,951 | 11/1981 | Hachisuka | 75/236 |
| 4,596,691 | 6/1986 | Ruppert et al. | 33/419 |
| 4,618,540 | 10/1986 | von Holst et al. | 428/552 |
| 4,624,830 | 11/1986 | Barr | 419/7 |
| 4,678,717 | 7/1987 | Nickola et al. | 428/553 |
| 4,704,251 | 11/1987 | Kraemer | 419/17 |
| 4,719,076 | 1/1988 | Geczy et al. | 419/8 |
| 5,032,352 | 7/1991 | Meeks et al. | 419/8 |
| 5,111,600 | 5/1992 | Lukavich et al. | 37/141 T |

*Primary Examiner*—Daniel D. Wasil
*Assistant Examiner*—John N. Greaves
*Attorney, Agent, or Firm*—Kenneth A. Rhoads

[57] ABSTRACT

A method for forming a wear surface on a metal substrate has a slurry which includes wear resistant particles, powdered steel, and binder system positioned on the metal substrate by retaining walls for a time sufficient for drying the slurry and forming a composite material of preselected thickness "T". The retaining walls are then removed and the substrate and the composite material are heated and passed through a rolling mill compressing the composite material.

29 Claims, No Drawings

METHOD FOR FORMING HARD PARTICLE WEAR SURFACES

TECHNICAL FIELD

The present invention relates to a method for forming hard particle wear surfaces on a steel part.

BACKGROUND ART

Much industrial effort has been devoted to developing ground-engaging tools with a reduced cost to wear life ratio. For example, new material compositions and heat treatments have been responsible for lowering the wear rates of cutting edges for earthworking blades and the tips for penetrating teeth. Moreover, various hard-facing materials have been weldingly applied to the exposed wear surfaces of such tools. Unfortunately, these thin hard facings wear away relatively quickly and it is necessary to apply additional layers at considerable expense of labor, time, equipment and the waste of natural resources. However, heretofore it has been difficult to apply such wear resistant material to relatively thin substrates.

The present invention is directed to overcome and improve one or more of the problems as set forth above.

DISCLOSURE OF THE INVENTION

In one aspect of the invention, a method is provided for forming a wear resistant composite material on a metal substrate. The surface of the metal substrate onto which the wear resistant composite material is to be attached is cleaned and retaining walls are built about the area onto which the wear resistant composite material is to be attached. A slurry formed of wear resistant particles, powdered steel, and binder system is positioned on the metal substrate within the retaining walls. The slurry is maintained within the retaining walls for a time sufficient for drying the slurry and forming a resultant composite material of a preselected thickness "T". The retaining walls are removed and the metal substrate and composite material are heated to a temperature greater than about 2,000 deg. F. The heated metal substrate and composite material are passed through a rolling mill and the composite material is compressed onto the metal substrate until the thickness "T" of the composite material is reduced to a thickness "t" of not greater than 50 percent of thickness "T".

BEST MODE FOR CARRYING OUT THE INVENTION

A metal substrate has a preselected length, width, thickness, and an outer surface. Preferably the metal substrate is steel and is an elongate plate having a thickness greater than about 2 mm.

The surface of the metal substrate onto which the wear resistant composite material is to be attached are cleaned and retaining walls are built about the area onto which the wear resistant composite material is to be attached. A slurry of wear resistant particles, powdered steel and a binder system is then formed and the slurry positioned on the metal substrate within the retaining walls. The slurry is then maintained within the retaining walls for a time sufficient for drying the slurry and forming a resultant composite material of a preselected thickness "T". The retaining walls are thereafter removed and the metal substrate and composite material are heated to a temperature greater than about 2,000 deg. F.

The heated metal substrate and composite material are then passed through a rolling mill and the composite material is compressed onto the metal substrate until the thickness "T" of the composite material is reduced to a thickness "t" of not greater than 50 percent of thickness "T".

The outer surface of the metal substrate is cleaned by grit blasting. The grit material are selected from one of aluminum oxide, soda-lime-silica glass, cast steel shot or cast iron shot. In the preferred embodiment the grit material is aluminum oxide with a particle size in the range of about 40$\mu$ to about 1 mm, preferably of about 100$\mu$. Further, subsequent to cleaning the area by grit blasting, cleaning can be by wire brushing the area onto which the wear resistant composite material is to be attached.

The retaining wall portion adjacent the area onto which the wear resistant composite material is to be attached is formed of a material having properties which will not bond to the slurry. The retaining wall portions can be, for example, steel plate covered with polytetrafluoroethylene tape.

The wear resistant composite material includes a mixture of the wear resistant particles, steel powder, and the binder system. The formed slurry includes a binder system selected from one of a first system of cellulose acetate and acetone or a second system of buffered methylcellulose and water. In the preferred embodiment the binder system is cellulose acetate and acetone. The acetone and the water are added to the respective mixtures until a high viscosity slurry results. The formed slurry has a viscosity in the range of about $8\times10^6$ to about $11\times10^8$ centipoise. Preferably the formed slurry has a viscosity in the range of about $42\times10^6$ centipoise. The slurry includes about 50 to about 70 percent by weight wear resistant particles, about 29 to about 49 percent by weight powdered steel and about 1 to about 4 percent by weight cellulose acetate. The powdered steel can be plain carbon steel or other types of steel. In the preferred embodiment, the powdered steel is 4630 steel. The powdered steel has a particle size in the range less than about +70 mesh, U.S. Sieve Size .

The wear resistant particles are selected from one of tungsten carbide, titanium carbide, aluminum oxide, zirconium oxide, chrome oxide, silicon dioxide, silicon nitride, diamond, and mixtures thereof. In the preferred embodiment the wear resistant element is tungsten carbide. The tungsten carbide is in granular form having a granular size in the range of about −7 mesh to about +300 mesh, U.S. Sieve Size. In the preferred embodiment the wear resistant material is tungsten carbide having a granular form of a granular size of −20 mesh to +30 mesh, U.S Sieve Size.

The slurry of wear resistant composite material is applied to the metal substrate in any desired pattern and design. For example, the resultant composite material on the metal substrate is nonlinear. The slurry is kept in the desired location on the substrate until is dries using the retaining walls. The thickness "T" of the composite material is in the range of about 4 mm to about 12 mm depending on the required wear resistance. In the preferred embodiment the thickness "T" is about 6 mm. After the slurry dries the retaining walls are removed.

The metal substrate and composite material are heated to a temperature of about 2100 deg. F. until the substrate reaches a uniform temperature. The substrate and composite material is then passed through a rolling mill a sufficient number of times until the thickness "t" of the consolidated composite material is about 3 mm. Example pressures that are applied on any single pass through the mill are at least 75,000 psia. However, it should be understood that the pressure applied and the number of passes through the mill that are required to sufficiently consolidate the composite material are functions of dimensions and volumes of the composite material and one skilled in the art can determine the optimum variables without undue experimentation. Desirably the compressed density of the wear resistant material should be greater than 95% of the theoretical density of the material.

Test of This Invention Was as Follows:

Substrate: ASTM A514 steel having dimensions of 500 mm length, 100 mm width, 4 mm thickness.

Grit Blasting: Aluminum oxide grit having a practical size of about 100μ.

Further Cleaning: Wire brush after grit blasting.

Slurry: 60 percent by weight tungsten carbide having a practical size of about −20 mesh to +30 mesh U.S. Sieve Size; 39 percent by weight 4630 powdered steel having a particle size in the range less than about +70 mesh U.S. Sieve Size; and 1 percent by weight cellulose acetate.

Slurry Viscosity: $42.0\times10^6$ centipoise.

Composite Material Thickness "T": 6 mm.

Metal Substrate and Composite Material: Heated in a controlled atmosphere furnace for a time of 30 minutes and to a temperature of 2100 degrees F.

Rolling Mill Pressure: 75,000 PSIA.

Number of Passes Through Rolling Mill: 5.

Configuration of Resultant Composite Material: Linear having a 500 mm length, 30 mm width, and a thickness "t" of 3 mm.

The resulting hard particle composite material on the metal substrate was tested in two ways. First, the composite material was impacted with sharp objects to test for adhesion to the substrate. The composite material could not be removed or disbonded from the substrate, even with multiple impacts.

Second, the substrate was bent 10 degrees and 30 degrees in an attempt to cause disbonding of the hard particle composition from the substrate. No disbonding of the hard particle composition occurred. In addition, the bent substrate was again impact tested with sharp objects, and again, no disbonding occurred.

The test indicated that the hard particle composition will remain in place during abrasive wear conditions that are typically seen in actual application.

INDUSTRIAL APPLICABILITY

The forming of wear surfaces on large, relatively thin metal substrates by the utilization of the method of this invention results in a saving of time, material, and a reduction in manufacturing cost. The metal substrate is cleaned with grit blasting followed by wire brushing. This insures maximum bonding of the wear resistant material during the hot rolling. The wear resistant material has the flexibility to be applied to the metal substrate in any desired complex pattern or design to optimize their wear resistance. The slurry is kept in the desired location on the substrate while it dries using retaining walls. After the slurry dries the walls are removed and the substrate and the composite material are heated. The substrate and the composite material are then passed through a rolling mill consolidating and metallurgically bonding the composite material to the substrate. The rolling mill combines the compresses and attachment operations into a single operation. The bonding between the wear resistant material and the metal substrate occurs because of the diffusion bonding between the two during the rolling operation.

Other aspects, objects and advantages of this invention can be obtained from a study of the disclosure and the appended claims.

What is claimed is:

1. A method for forming a wear resistant composite material on a metal substrate, comprising:

cleaning the surface of the metal substrate onto which the wear resistant composite material is to be attached;

building retaining walls about the area onto which the wear resistant composite material is to be attached;

forming a slurry of wear resistant particles, powdered steel and binder system;

positioning the slurry on the metal substrate within the retaining walls;

maintaining the slurry within the retaining walls for a time sufficient for drying the slurry and forming a resultant composite material of a preselected thickness "T";

removing the retaining walls;

heating the metal substrate and composite material to a temperature greater than about 2,000 deg. F.;

passing the heated metal substrate and composite material through a rolling mill; and compressing the composite material onto the metal substrate until the thickness "T" of the composite material is reduced to a thickness "t" of not greater than 50 percent of thickness "T".

2. A method, as set forth in claim 1, wherein the slurry includes about 50 to about 70 percent by weight wear resistant particles and about 29 to about 49 percent by weight powdered steel.

3. A method, as set forth in claim 1, wherein the powdered steel is plain carbon steel.

4. A method, as set forth in claim 1, wherein the powdered steel is 4630 steel.

5. A method, as set forth in claim 1, wherein the powdered steel has a particle size in the range of less than about +70 mesh, U.S. Sieve Size.

6. A method, as set forth in claim 1, wherein the wear resistant particles are selected from one of tungsten carbide, titanium carbide, aluminum oxide, zirconium oxide, chrome oxide, silicon dioxide, silicon nitride, diamond, and mixtures thereof.

7. A method, as set forth in claim 6, wherein the wear resistant material is tungsten carbide.

8. A method, as set forth in claim 7, wherein the tungsten carbide is in granular form having a granule size in the range of about −7 mesh to about +300 mesh, U.S. Sieve Size.

9. A method, as set forth in claim 4, wherein the wear resistant element is tungsten carbide having a granular form of a granule size in the range of about −7 mesh to about +300 mesh, U.S. Sieve Size.

10. A method, as set forth in claim 1, wherein the retaining wall portions adjacent the area onto which the wear resistant composite material is to be attached is formed of a material having properties which will not bond to the slurry.

11. A method, as set forth in claim 10, wherein the retaining wall portions are polytetrafluoroethylene.

12. A method, as set forth in claim 1, wherein the slurry includes a binder system selected from one of a first binder system of cellulose acetate and acetone, and a second binder system of buffered methylcellulose and water.

13. A method, as set forth in claim 12, wherein the binder system is cellulose acetate and acetone.

14. A method, as set forth in claim 13, wherein the formed slurry includes about 1 to about 4 percent by weight cellulose acetate.

15. A method, as set forth in claim 1, wherein the formed slurry has a viscosity in the range of about $8\times10^6$ to about $11\times10^8$ centipoise.

16. A method, as set forth in claim 15, wherein the formed slurry has a viscosity in the range of about $42.0\times10^6$ centipoise.

17. A method, as set forth in claim 1, wherein the metal substrate is steel.

18. A method, as set forth in claim 17, wherein the metal substrate is an elongated plate having a thickness greater than about 2 mm.

19. A method, as set forth in claim 1, wherein the thickness "T" of the composite material is in the range of about 4 mm to about 12 mm.

20. A method, as set forth in claim 19, wherein the thickness "T" is about 6 mm.

21. A method, as set forth in claim 1, wherein the metal substrate and composite material is heated to a temperature of about 2100 deg. F.

22. A method, as set forth in claim 1, wherein the metal substrate is cleaned by grit blasting.

23. A method, as set forth in claim 22, including wire brushing the area onto which the wear resistant composite material is to be attached subsequent to cleaning said area by grit blasting.

24. A method, as set forth in claim 22, wherein the grit material is selected from one of aluminum oxide, soda-lime-silica glass, cast steel shot, and cast iron shot.

25. A method, as set forth in claim 24, wherein the grit material is aluminum oxide.

26. A method, as set forth in claim 25, wherein the grit material has a particle size in the range of about 40$\mu$ to about 1 mm.

27. A method, as set forth in claim 1, wherein the grit material has a particle size of about 100$\mu$.

28. A method, as set forth in claim 1, wherein the thickness "t" of the consolidated composite material is about 3 mm.

29. A method, as set forth in claim 1, wherein the resultant composite material on the metal substrate is nonlinear.

* * * * *